US006406016B1

(12) United States Patent
Ehara et al.

(10) Patent No.: US 6,406,016 B1
(45) Date of Patent: Jun. 18, 2002

(54) APPARATUS FOR DISPENSING THIN FLAT ARTICLES

(75) Inventors: Takashi Ehara; Kenichi Tezuka; Yoshitaka Itoh; Kenji Saito, all of Hachioji (JP)

(73) Assignee: Asahi Seiko Co. Ltd., Tokyo (JP)

( * ) Notice: Subject to any disclaimer, the term of this patent is extended or adjusted under 35 U.S.C. 154(b) by 0 days.

(21) Appl. No.: 09/392,357

(22) Filed: Sep. 8, 1999

(Under 37 CFR 1.47)

(30) Foreign Application Priority Data

Sep. 8, 1998 (JP) ..... 10-291256
Sep. 16, 1998 (JP) ..... 10-301598

(51) Int. Cl.[7] ..... B65H 3/04; B65H 3/12

(52) U.S. Cl. ..... 271/12; 271/13; 271/104; 271/34; 902/15; 902/16

(58) Field of Search ..... 271/12, 13, 104, 271/99, 34, 35, 134; 402/14–16

(56) References Cited

U.S. PATENT DOCUMENTS 3,097,463 A * 7/1963 Neal et al. ..... 53/186
3,625,508 A * 12/1971 Shiragai ..... 271/34
3,735,976 A * 5/1973 Watson ..... 271/34
4,020,972 A 5/1977 Lundblad
4,363,478 A * 12/1982 Tsukasaki ..... 271/134
4,678,175 A * 7/1987 Arldt et al. ..... 271/34
5,074,539 A 12/1991 Wells et al.
5,139,251 A * 8/1992 Ricciardi ..... 271/34

FOREIGN PATENT DOCUMENTS

| | | |
|---|---|---|
| DE | 1267005 | 4/1968 |
| EP | 812790 | 12/1997 |
| EP | 812790 | 9/1999 |
| FR | 7716831 | 1/1979 |

* cited by examiner

*Primary Examiner*—Christopher P. Ellis
*Assistant Examiner*—Mark A. Deuble
(74) *Attorney, Agent, or Firm*—Price and Gess

(57) ABSTRACT

A dispensing apparatus for thin flat articles, such as monetary currency bills, includes a plenum chamber having an aperture of a size smaller than the articles to be dispensed. A suction device is connected to the plenum chamber to provide sufficient negative pressure to adhere an article to the aperture. A contact member, such as an endless belt, is mounted for movement across the aperture to drive the article adhering to the aperture for release from the stack of articles. The stack of articles can be stored in a storage tray and biased towards the plenum chamber aperture. A series of spacer members can relieve part of the bias pressure. The released articles can be counted and stored in a storage chamber until a predetermined number of articles are accumulated. Subsequently, the passageway from the storage chamber to a dispenser tray can be opened and the articles ejected to the user.

8 Claims, 13 Drawing Sheets

APPARATUS FOR DISPENSING THIN FLAT ARTICLES

BACKGROUND OF THE INVENTION

1. Field of the Invention

The present invention is directed to an apparatus for dispensing thin flat articles and, more particularly, a compact storage and dispensing unit for dispensing from vending machines objects such as paper currency, and other flexible paper and plastic objects of a lightweight configuration, such as tickets, telephone cards and the like.

2. Description of Related Art

It is desirable to dispense lightweight flexible objects, such as notes, currency or monetary bills from vending machines, automatic teller machines, currency exchange machines, etc. Vending machines are also used to dispense tickets and telephone cards. In all of these machines, it is important to accurately remove a predetermined number of articles from a stacked storage position and to dispense them in a safe and accurate manner to the user.

Reference can be made to FIG. 6 which shows one view from Japanese Patent Application No. 8-188006. In this embodiment, a baseboard 11' interconnects a central end part 12' and a cover board 14'. Extending from the central end part 12' is a bottom board 14' with an appended installation member 15'. Side rollers 16', 17' can rotate for dispensing an article that has been picked up by a suction apparatus 21'. The suction apparatus 21' includes an exhaust duct 26' and a roller member 27' that is driven by a pulley belt 31' mounted on pulley guides 28', 30' that are driven by an electric motor 29'. Support pads 32', 33' are provided at the bottom and apertures 22', 23' permit the suction effect to initially grasp an article which is then driven by the roller 27' for release. As can be seen, the article is transported to the rollers 16', 17' with the suction apparatus supported by the frame 24'. Such a structure is not always dependable and when applied to circulating monetary notes a problem can occur, in that, the contact friction can become insufficient between the drive roller 27' and the note. Also, frequently notes are bent at a center portion and this can cause a problem in ensuring a unitary drive force.

As can be appreciated in dispensing articles such as monetary bills, it is essential that the device accurately dispense the stored bills, especially when installed at a remote location as patrons of such a machine could vent their frustration if the appropriate exchange of monetary notes is not accurate. Thus, the prior art is still seeking to optimize the accurate dispensing of thin flexible articles, such as monetary bills in relatively compact structures which can be mounted in a versatile manner in vending machines.

SUMMARY OF THE INVENTION

The present invention is directed to a dispensing apparatus for thin flat articles and includes a plenum chamber having an aperture of a size smaller than the articles to be dispensed. A suction device, such as a pair of fan units can be connected to the reverse side of the plenum chamber, provides sufficient negative pressure to adhere an article to the aperture of the plenum chamber. A contact member, such as an endless belt, is mounted for movement across the aperture to drive the article adhering to the aperture traverse to the aperture when the endless belt member is driven. An electric motor is mounted on a mounting bracket which can be attached to an exterior side of the plenum chamber. The mounting bracket can have a guide frame that will extend across the aperture of the plenum chamber for guiding and supporting the endless belt member independent of the aperture frame. Preferably the endless belt member is made from a material which provides sufficient contact friction, such as a rubber belt, with the article. The articles can be monetary currency which are bundled in stacks and mounted in replaceable storage trays. The storage tray can have a spring-biased support member that moves across the tray to advance the bills towards a frame opening that is aligned with the aperture of the plenum chamber.

A pressure reducing apparatus having a series of spacer members can be activated to grasp the edges of the stack of bills and thereby relieve the pressure on the foremost bills. The spacer members removably engage the stacked bills upon an initiation of a bill dispensing operation. When the bill or article is dispensed from the stack, a sensor can monitor the release of the bill and through a controller circuit can activate the motor to rotate in a reverse direction to prevent any succeeding bills from also being released with the initial bill. The bills can be forwarded to a storage chamber which has a guide piece that opens and controls a passageway for ejecting the bills to the user. Optical sensors can accurately count the number of bills which are accumulated in the storage chamber prior to dispensing. When the appropriate number of bills enter the storage chamber, the guide piece can be activated to open the passageway and a roller can contact a belt supporting the stored bills and eject them into a tray for access by the user.

Sensors can also appropriately determine if a bill has inadvertently been ejected from the stack and upon such a detection, the bill can be forwarded to a return bin included in each of the replaceable storage trays.

BRIEF DESCRIPTION OF THE DRAWINGS

The general purpose of this invention, as well as a preferred mode of use, its objects and advantages will best be understood by reference to the following detailed description of illustrative embodiments with reference to the accompanying drawings in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide a dispensing apparatus for a stack of thin flat articles, such as monetary notes or bills.

The present invention seeks to minimize the size of a dispensing apparatus for dispensing stacked thin flexible articles, such as monetary currency bills in a relatively economical manner. One of the features of the present invention is to efficiently dispense the bills as the uppermost bills are sucked from a stack by gripping and driving the bills by a contact member, such as an endless belt extending along the longitudinal axis of the bills. Additionally, the belt can be both positively driven in a forward and a reverse direction. The dispensing apparatus of the present invention can be mounted in various orientations including vertical, horizontal and even upside down to accommodate the available space required in various vending machines.

The present invention also has the capacity to both count and payout the bills in a secure manner. As can be appreciated, the flat flexible articles disclosed in the preferred embodiments are monetary notes, but the concept of notes can be used broadly for other forms of bendable paper or plastics, such as flexible telephone cards and tickets.

Figure 1:
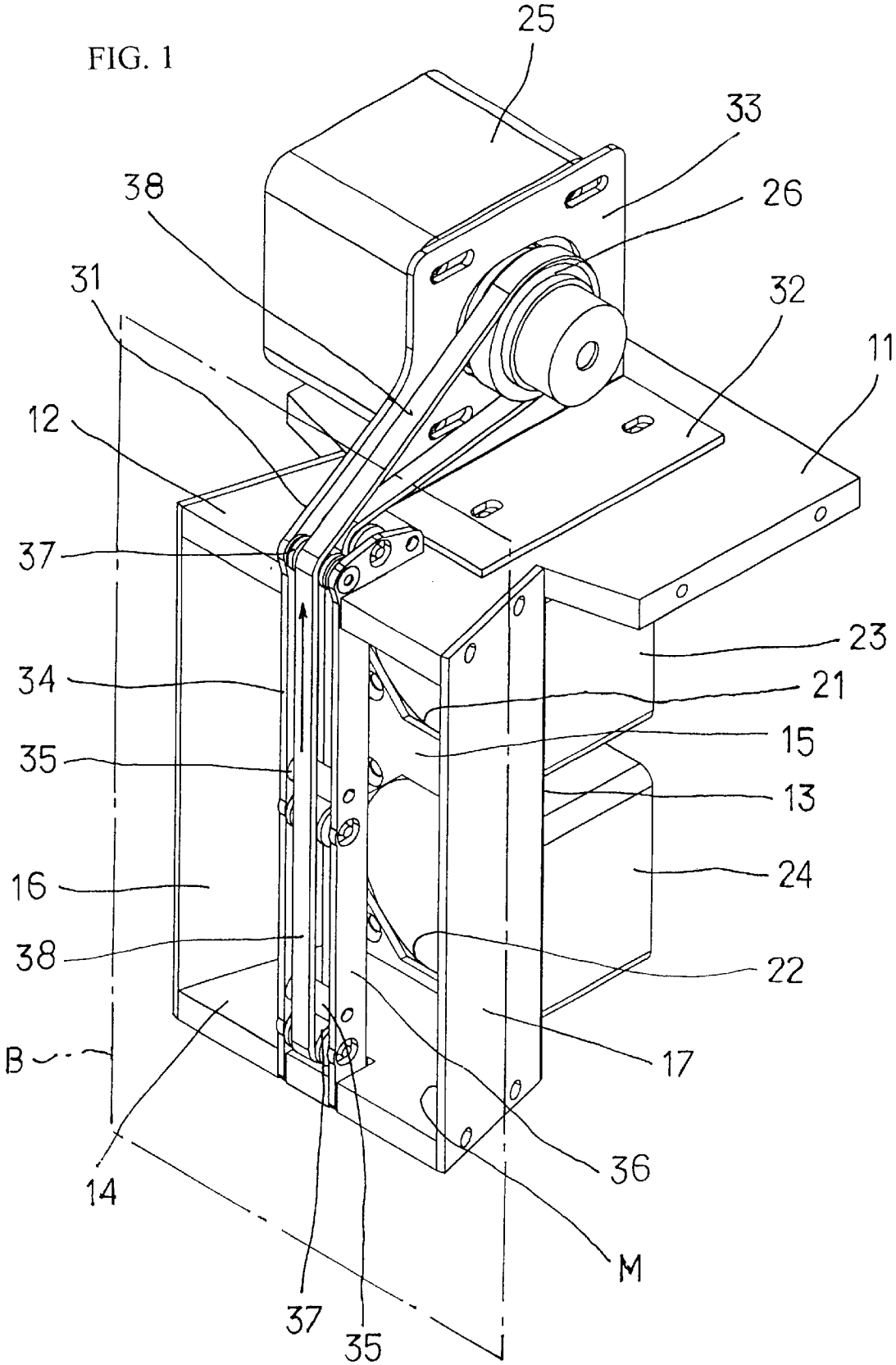
FIG. 1 is a perspective view of a first embodiment of a dispenser unit of the present invention.

Referring to FIG. 1, a suction housing assembly 15 is disclosed having a baseboard 11 with a truncated cut central end part 12. Side panels 16, 17 are fastened respectively to the central end part 12 and a bottom part 14 to form a plenum chamber having a rectangular opening or aperture M. Extending across a central length of the opening M is a contact member, such as a belt 38, that can be driven through a pulley 26 by an electric step motor 25. As can be seen, the electric motor 25 and the pulley 26 can be mounted on an L-shaped metal bracket, having a mounting base 32 and a mounting bracket 33, which is secured on a surface of the baseboard 11. The mounting bracket 33 has an extension arm or frame body 31 that comprises a pair of guide frames 34, 36 which extend across the opening M. The guide frames 34, 36 can have appropriate holes or apertures that can be journaled with appropriate bearing arrangements to provide rollers 37 and spacers 35 so that the endless belt 38 can be looped to extend between the guide frames 34 and 36.

The belt 38 can be made of rubber, a synthetic rubber or other flexible material that can provide a sufficient frictional force to the surface of the stacked bills B. As can be appreciated a pair of belts could also be used and it is possible to have vent openings and to use a wider belt than the slender one depicted in FIGS. 1 through 5. Additionally, a caterpillar-type belt, such as a rubber chain, could replace the belt 38 as long as the replacement member has sufficient friction contact to drag the adhered bill against the negative pressure in the plenum chamber. A plurality of spacers 35 are shown installed on the guide frame 34, but an alternative embodiment could just use a plurality of rollers 37. Attached to the plenum chamber 15 are a pair of suction devices, such as fans 23, 24. The fans 23, 24 can be driven by separate motors (not shown) in response to drive signals from a controller unit 100.

Figure 2:
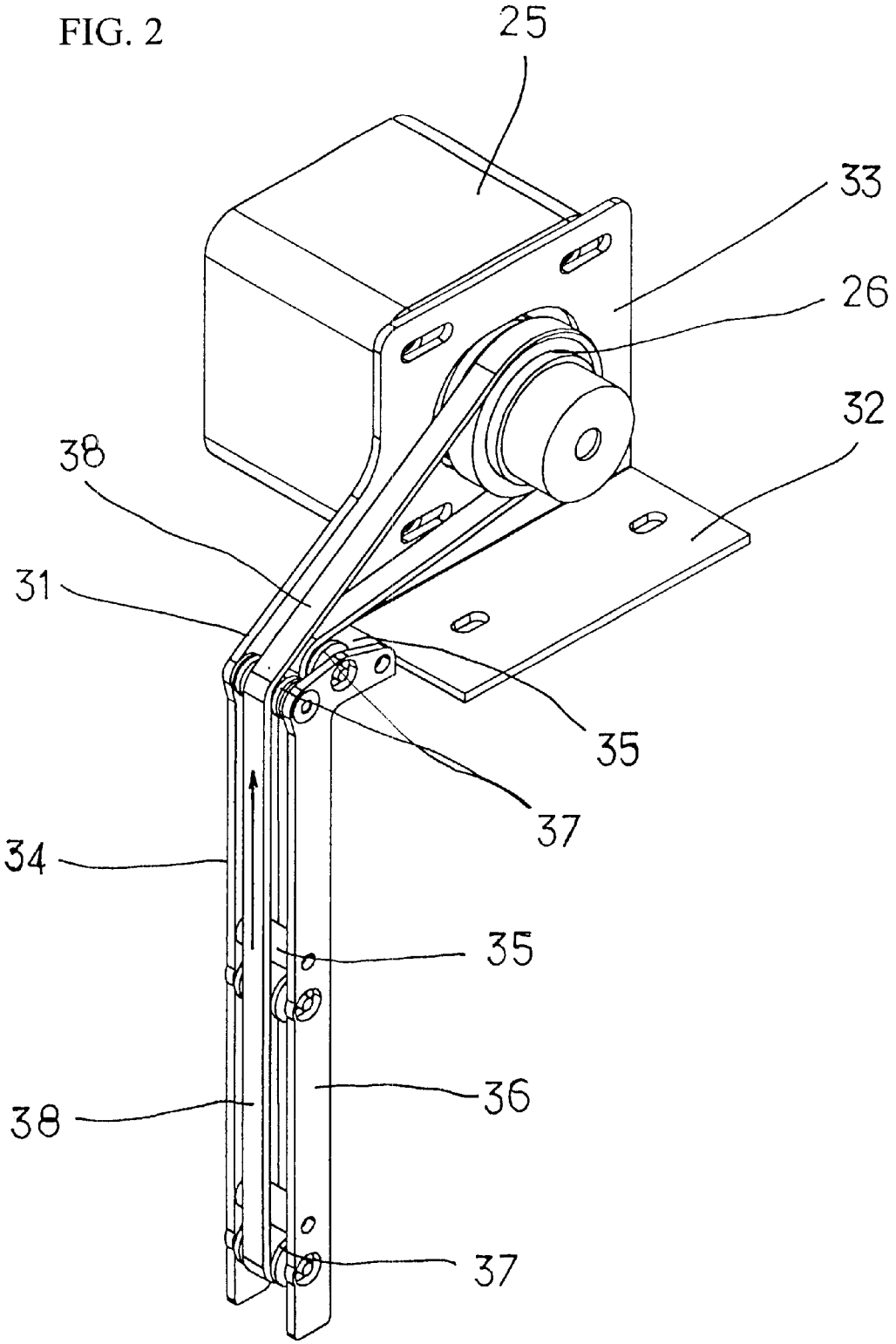
FIG. 2 is a perspective view disclosing the belt driving portions of FIG. 1.

Referring to FIG. 2, the driving component of the endless belt 38 is shown. It should be appreciated that the belt 38 can have serrated portions or teeth on a reverse side that can mesh with teeth (not shown) on the pulley 26 to provide a positive traction. The rollers 37 can facilitate the change in directional movement of the belt 38, while the spacers 35 can provide sufficient support to prevent deflection of the belt 38 as it travels across the opening M. As shown, three spacers 35 can be utilized, while four small rollers 37 which can be idler rollers can be mounted between the guide frame members 34, 36. Appropriate notches can be cut into the central end part 12 and the bottom board 14 as shown in FIG. 1, so that the combination of the guide frame mounting bracket 33 and electric step motor 25 can be installed as one unit on the plenum housing structure without support adjacent the aperture M. This permits convenient servicing and assists in replacing endless belts 38.

Figure 3:
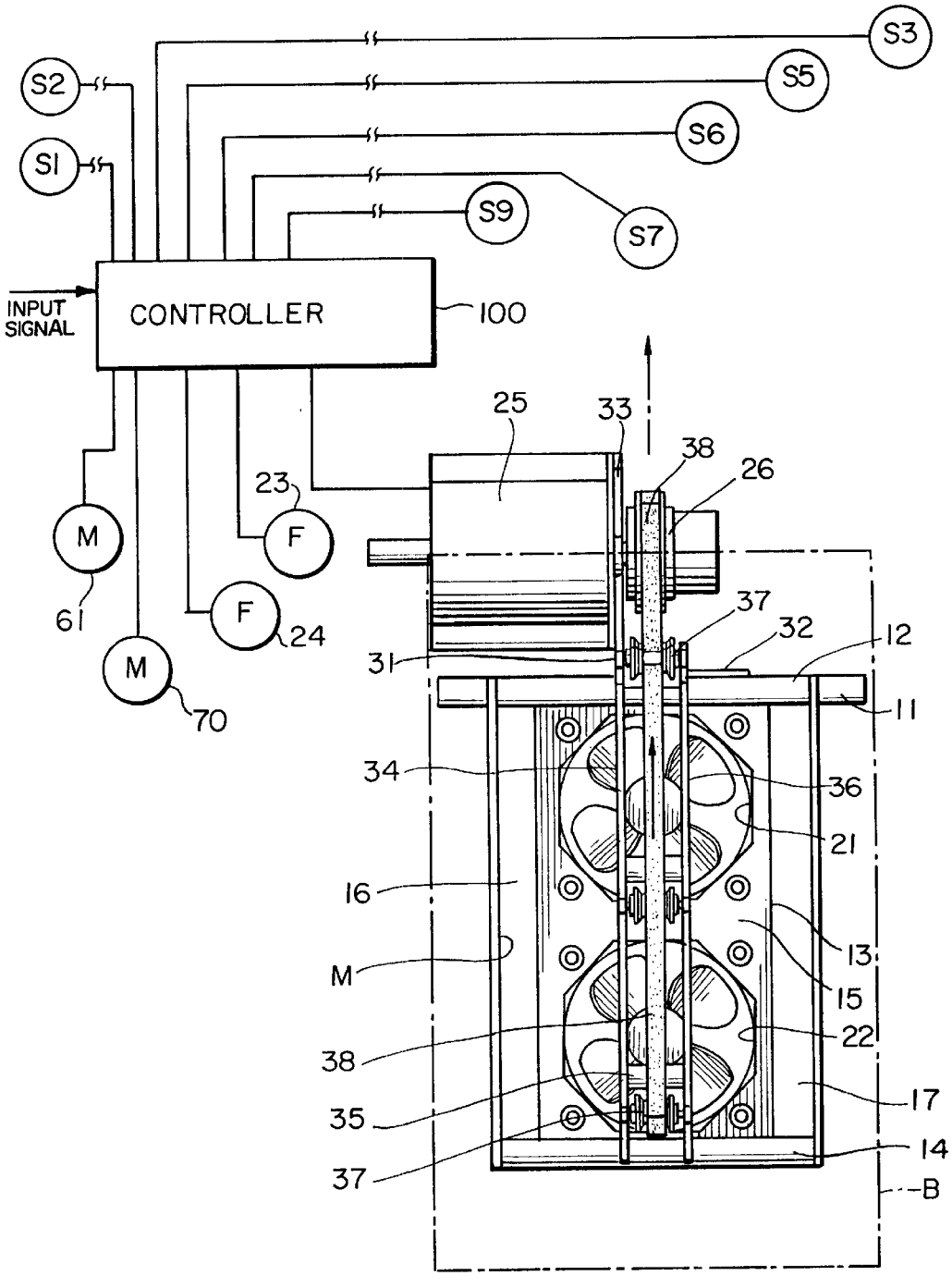
FIG. 3 is an elevated front view of the first embodiment.

Referring to FIG. 3, a front elevated view is disclosed. Note in the FIGS. 1 and 3, the phantom line B discloses the relative shape or size of the stack of bills B relative to the opening M of the plenum chamber 15. The stepper motor 25 can be reverse rotated by a controller 100, in correlation with sensor inputs such as the sensor S7, so that the belt contact surface that extends across the opening M can move in either an up or down direction.

Figure 4:
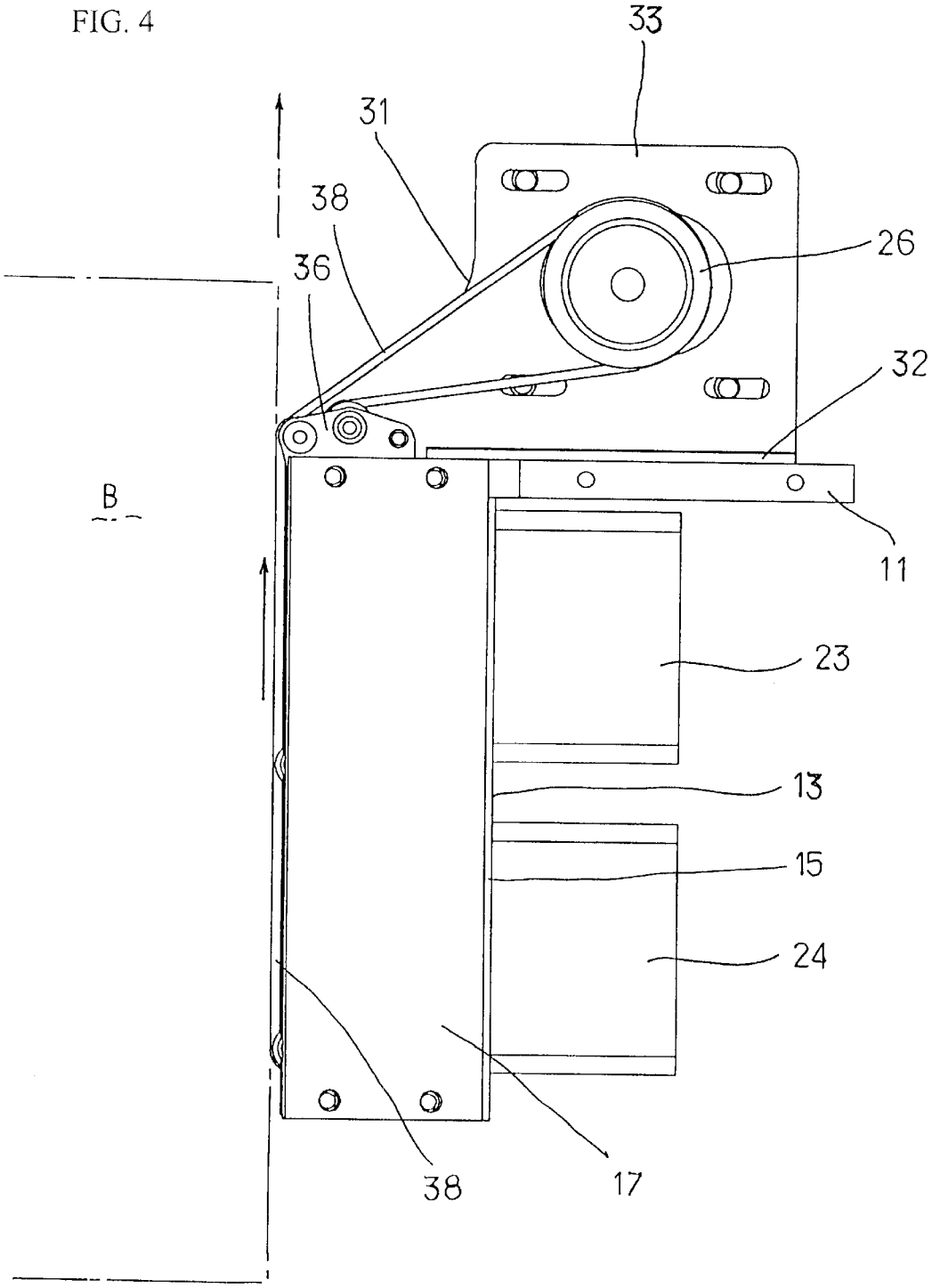
FIG. 4 is a side view of the first embodiment.
Figure 5:
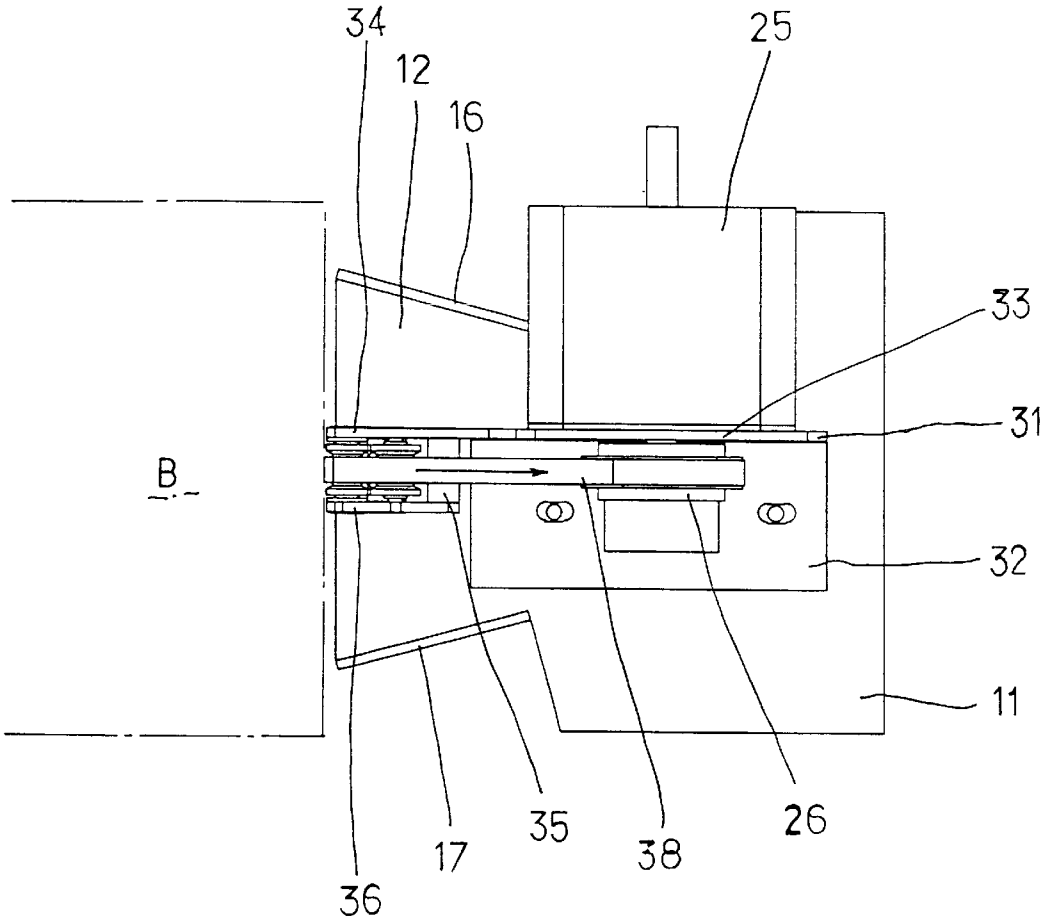
FIG. 5 is a top plan view of the first embodiment.
Figure 6:
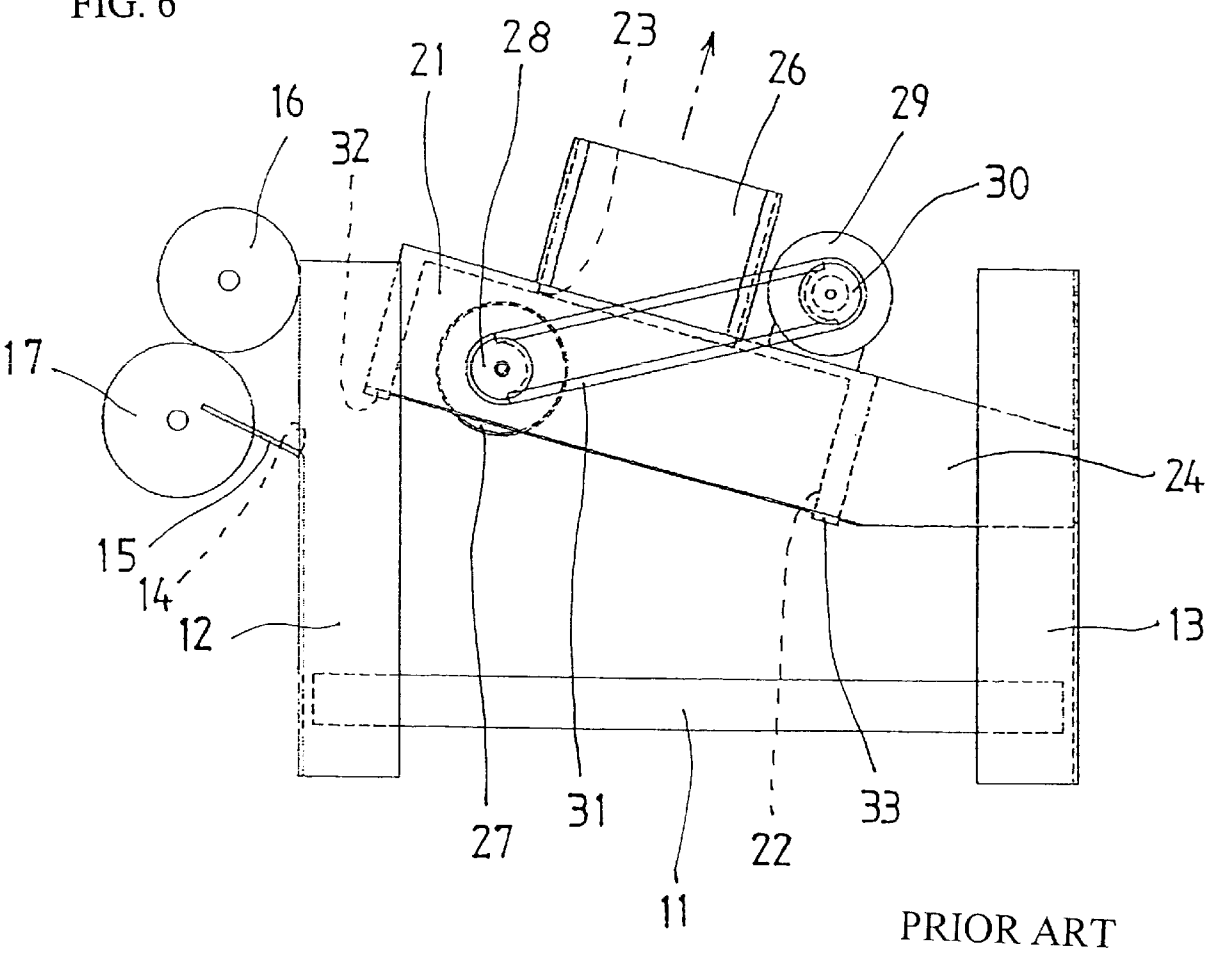
FIG. 6 PRIOR ART
FIG. 6 is a side partial cross section view of an embodiment of the prior art.

It should be appreciated that the particular mounting of the belt 38 shown in the views of FIGS. 1 through 4 is not a limitation on the manner in which the bill dispenser unit can be mounted within a vending machine. As shown in FIG. 4, a stack of bills B, such as 100,000 yen bills are arranged in a vertical alignment and are positioned in front of the open mouth M. The stack of currency notes B are slightly pressed against the open mouth M and when the fan devices or suction apparatus 23, 24 are driven, an exhaust of air from the plenum chamber 15, occurs and a negative pressure is generated in the plenum chamber 15 so that the first note on the surface of the stack B is attached to the open mouth M. At the same time, the electric motor 25 is positively rotated and the thin belt 38 which can be made from rubber will move in the direction of the solid arrow shown in the drawings. As a result of the friction of the belt 38, a bill that has been attached to the open mouth M is driven in a vertical direction. The top part of the first bill will be inserted between a pair of rollers, see FIG. 7A. When the first note is further drawn up in the same direction of the arrow as a result of engagement with the rollers 71, this movement or passage of the bill is detected by an optical sensor S7 and the electric motor 25 is then reverse rotated. As a result of the reverse rotation of the belt 38, the second note which is positioned behind the first note, can be prevented from being sent with the first note. The endless belt 38 can be made of natural rubber, synthetic rubber or other material that provides an appropriate friction surface for engaging and moving the currency notes. It should also be appreciated that a pair of belts in an alternative arrangement can be arranged for providing two spaced points of contact across the longitudinal surface of the note. Additionally, the belt 38 can be made wider and vents or openings can also be provided in the belt. It is also possible that a caterpillar-type belt, such as rubber chain, may be used to replace the belt 38. As can also be appreciated, if the guide member 34 is sufficiently strong, it can juxtaposition the rollers and idlers so that it may not be necessary to also include the guide frame 36. Such an arrangement can further ensure that the service installation of replacement belts 38 can be conveniently installed.

In this embodiment, a pair of fan devices 23, 24 are disclosed. However, it can be appreciated that one fan device can be used as long as a sufficient suction force is generated to adhere the surface of the note to the aperture or opening M. Since the electric step motor 25, mounting base 32 and guide frames 34, 36 can constitute a unitary construction, it is convenient for a service person to remove this part and replace or install new parts or new belts.

In addition, since all the necessary component parts are fixed to the baseboard 11, the baseboard 11 can be positioned in an inclined manner or may be mounted upright, or even upside down, to adapt to the particular configuration of the vending machine. Thus, by a relatively simple construction, a highly efficient and accurate combination of the small fans, a belt made of rubber and an electric step motor can be provided for incorporation into various forms of vending machines.

In the second embodiment of the present invention disclosed herein, the structure for applying a negative pressure to attach the top article from a stack of articles to the apertures and to positively contact and drive the article while preventing succeeding articles from being also released is disclosed as a component in an assembly capable of also storing, counting and dispensing the articles, such as monetary notes. This structure has a box-like configuration and can be integrated within a vending machine or ATM machine.

Figure 7A:
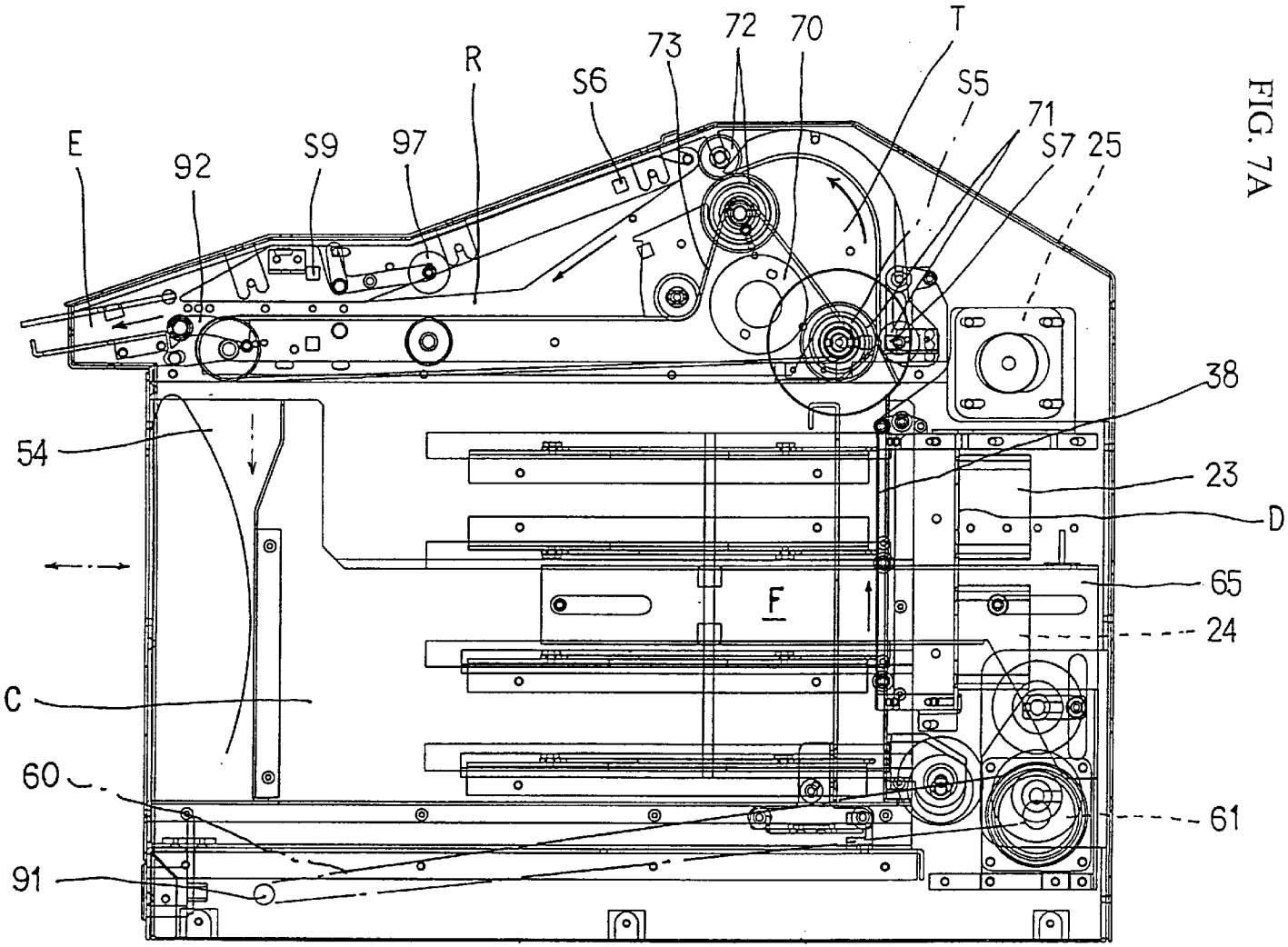
FIG. 7A is a left side sectional view of a second embodiment of the present invention.

Referring to FIG. 7A, a cross sectional view is shown and includes basically a storage section or tray C which can constitute a box-like form that can be installed with a predetermined number of articles or in this embodiment, monetary bills B. As can be determined, the tray occupies approximately half of the volume of the structure. The tray C is open at an upper portion thereof and can be removed from and inserted into the structure. As can be appreciated, preloaded bills in replacement trays C can be used by a service person to replenish the supply of bills in this structure. As noted with respect to FIG. 1, the bills B are aligned in an upright or vertical direction so that their longitudinal length is presented to the aperture M. The pickup device D which is of the form disclosed in FIGS. 1–5 is mounted at the right hand side of the structure shown at FIG. 7A. Mounted above the pickup device D is a transport structure T.

Cooperating with the insertion of the storage case C is a pressure-relieving structure F that can assist in separating the stacked bills by grasping outstanding vertical edges of the bills and releasing some of a biased pressure for directing the bills towards the open mouth M of the dispenser D.

Figure 12B:
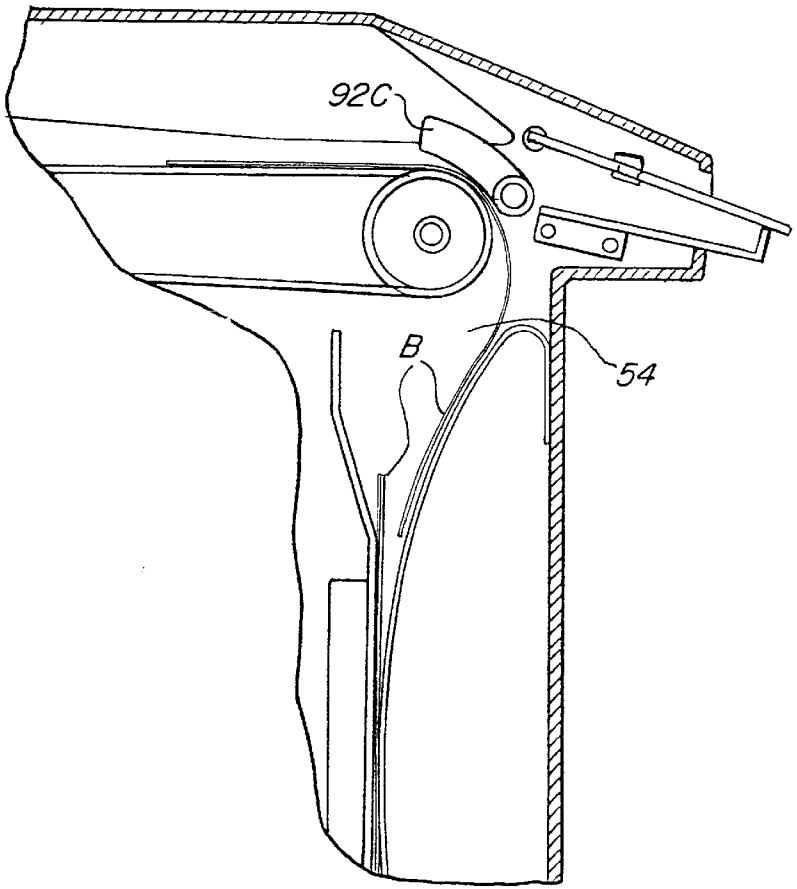
FIGS. 12A and 12B are partial cross sectional views of the guide piece of FIG. 8.
Figure 12A:
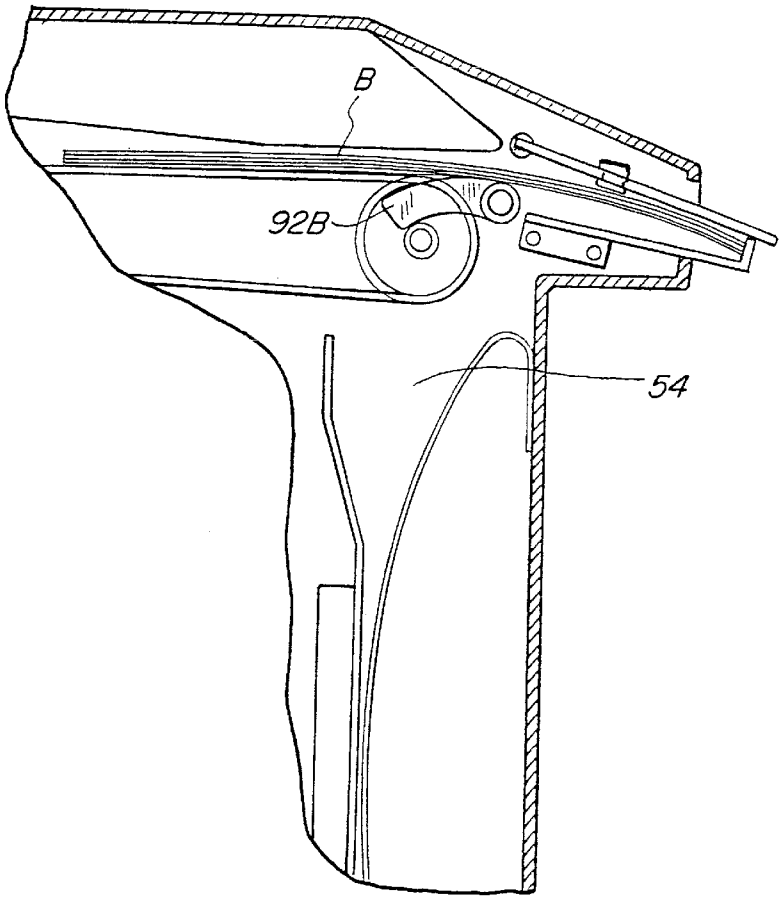

Mounted above the dispenser section D is a bill-dispensing and counting unit T which receives the dispensed bills and directs them to a storage chamber R. When a sufficient number of bills are stored in the storing room R, they then can be dispensed through an exit chamber or room E so that they are available to the user of the vending machine. A pivotably mounted guide piece 92 can operate to open and close the exit of the storage chamber R, see FIG. 8 and FIG. 12A.

Figure 9:
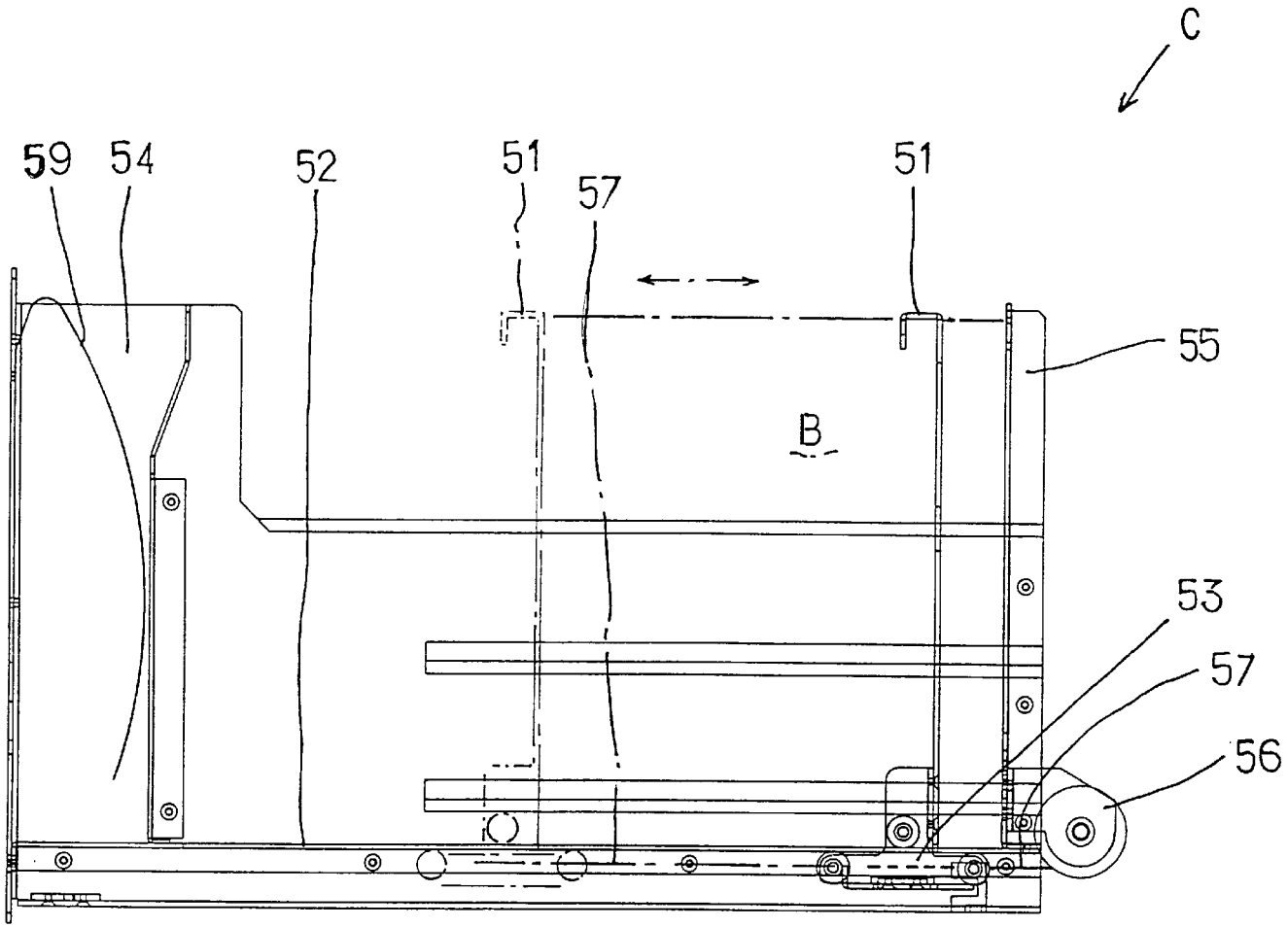
FIG. 9 is a schematic side section view of the storage compartment of the second embodiment.

FIG. 7A discloses a schematic cross sectional left side elevational view of the monetary dispensing, counting and ejection mechanism of the second embodiment. At the upper left-hand corner, of FIG. 7A, is the dispenser chute or tray E where the bills will be collected by the user. The bills are stored in bulk in the lower storage area tray C. This area is designed to receive, as shown in FIG. 9, a storage tray or storage case having at its right side an open aperture frame 55. Mounted within the storage tray is a movable rectangular support wall 51 which can be journaled to slide along a set of rails 52 through the use of small rollers 53 which are sandwiched between the rails, respectively. A tension or belt spring device 56 is fixed to a center bottom portion of the standing upright wall 51 and biases it towards the aperture frame 55. This belt spring device basically draws the wall 51 forward as the spring winds about a reel. Similar types of devices are frequently used as takeup spools in tape measures. The belt spring device 56 can be mounted at the center of the bottom part of the window frame 55 and is fixed to the center of the bottom part of the standing wall or board 51. As a result, when the standing wall 51 is pulled to the left, as shown in FIG. 9, a spring-biased force is created to return it to the position shown in solid lines. Accordingly, when the service technician wants to replace the bills in the storage tray C, he or she manually pulls the rectangular wall 51 to the left and carefully inserts a stack of monetary bills in a vertical position. The notes B that are stored between the standing up board or wall 51 and the aperture frame 55 are spring-biased to force the bills forward to the aperture opening. At the left side of the storage tray is a return bin or collection room 54 and a leaf plate or release spring 59 that is designed to receive bills that may have been inadvertently removed from the bundle B.

As shown in the FIG. 7A, the dispensing unit D of the configuration of FIGS. 1–5 is appropriately mounted so that the opening M is available adjacent the apertured wall or end member 55. As can be seen, the electric motor 25 is supported so that the elongated frame body 31 that supports the belt 38 extends vertically down and across a significant portion of the opening in the frame member 55. As is also seen in FIG. 7A, the fan units 23, 24 are capable of being activated to thereby create a low pressure in the plenum chamber 15 so that the foremost vertically arranged bill can be drawn to the aperture opening M. As mentioned before, the electric motor 25 is a step motor which can rotate in both a forward and reverse direction.

A controller 100 can receive various sensor signals through an I/O interface and can control the operation of the motors, fans and other components, see FIG. 3. For example, a microprocessor based control circuit upon receipt of a user input signal can compute the number of bills to be dispensed and can coordinate the dispensing, collection and disbursement of the bills based on the sensor signals $S_1$, $S_2$, $S_3$, $S_4$, $S_5$, $S_6$, $S_7$ and $S_9$ that monitor the various operations.

Figure 7B:
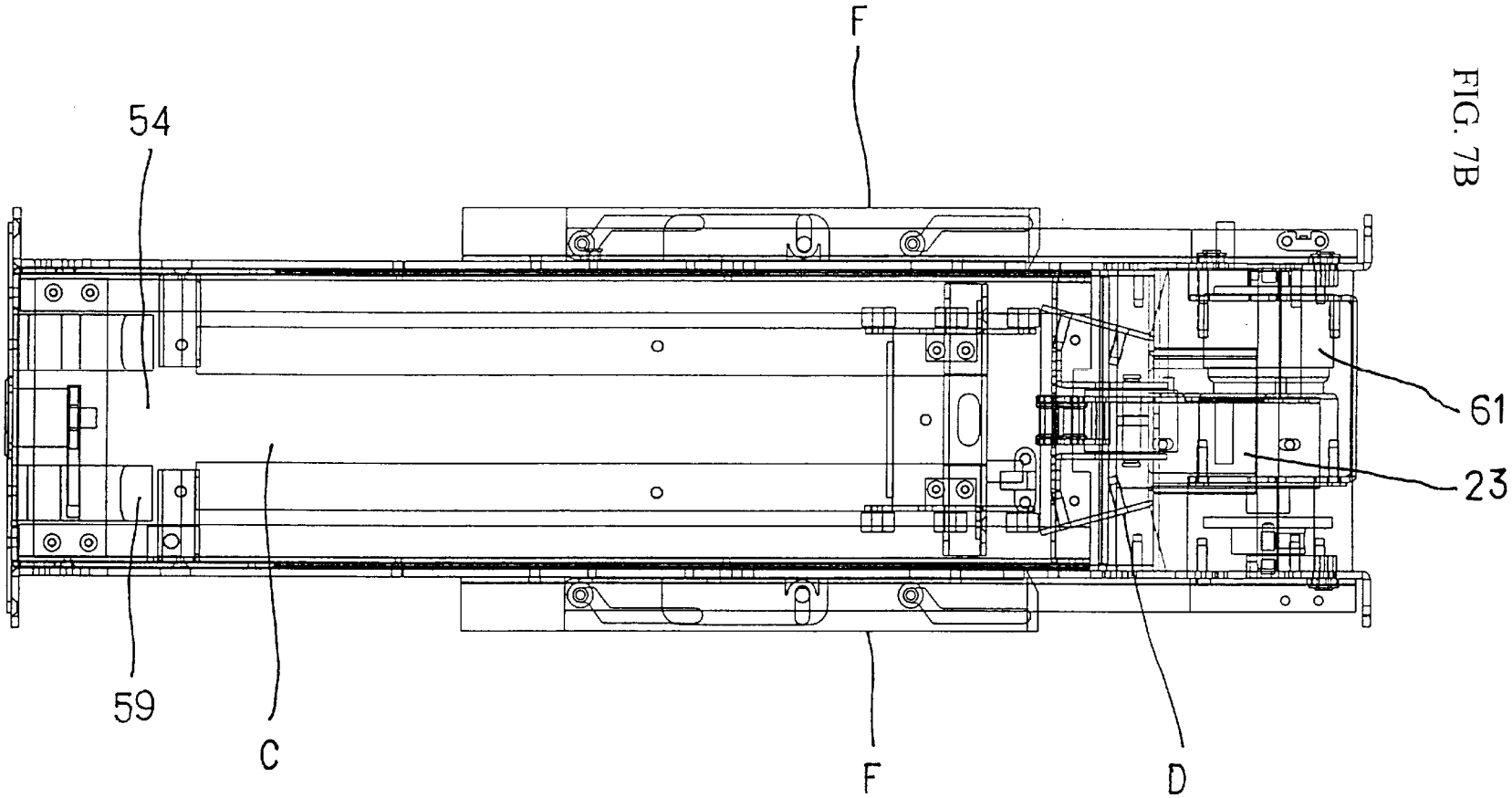
FIG. 7B is a top plan view of FIG. 7A with the top housing removed.

As another feature of the present invention, a pressure reducing device F can be activated to contact the stacked bills B and to counter the spring bias that is exerted on the support wall 51. Reference can be made to FIG. 7B to disclose a plan view of the storage chamber and storage tray C and its alignment with dispensing unit D. As can be seen, there are slotted L-shaped cam openings on either side of FIG. 7B which are used to activate the pressure reducing device F.

Figure 10:
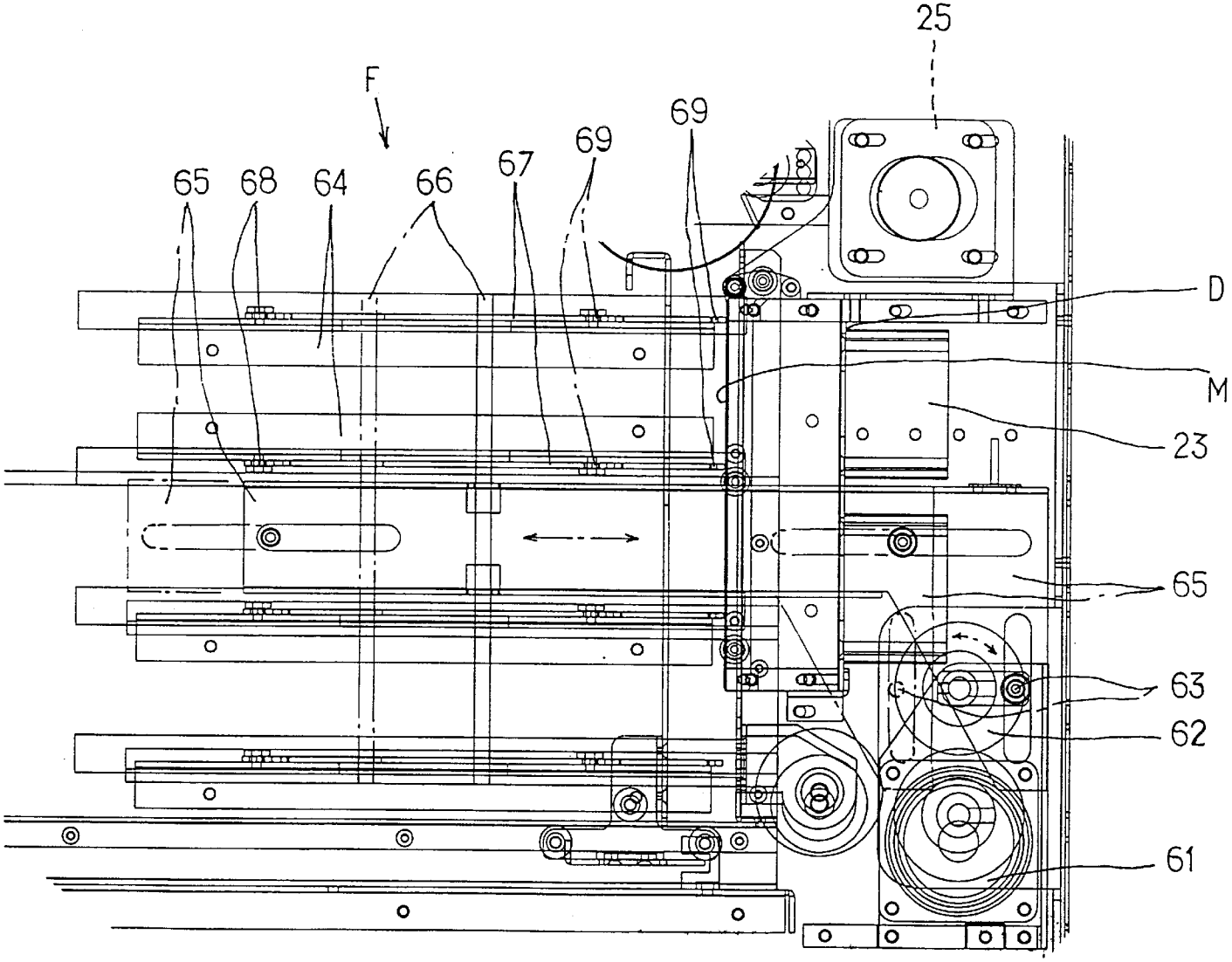
FIG. 10 is a partial sectional view of FIG. 7A.
Figure 11:
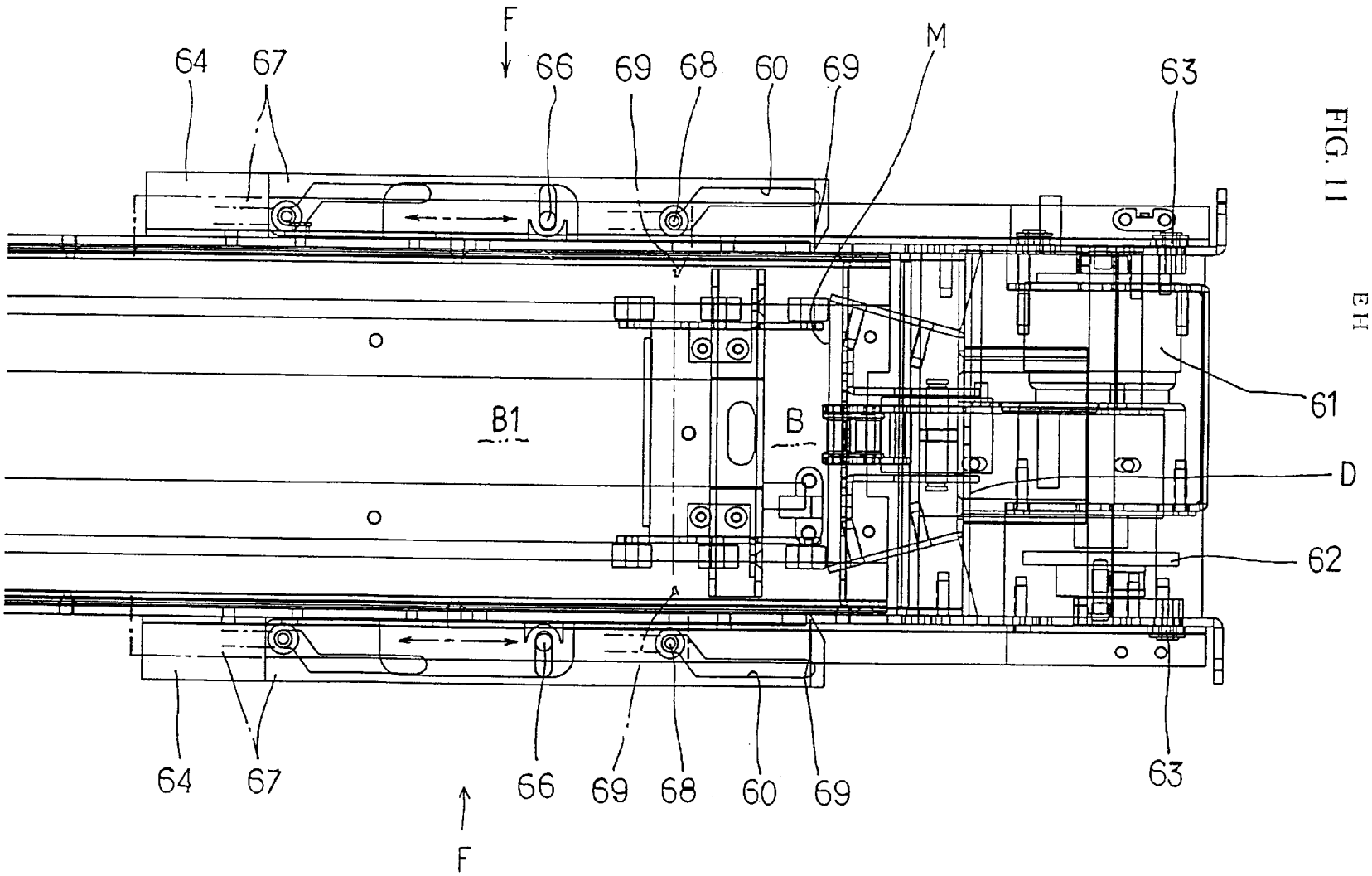
FIG. 11 is a top plan view of FIG. 10.

Referring to FIGS. 10 and 11, an electric motor 61 which can also rotate in a forward and reverse direction, is mounted for driving a gear 62 which has appended thereto a set of rollers 63. The operation board 65 has a slot for receiving the rollers 63. The combination of slots and rollers creates a crank arrangement so that by activation of the electric motor 61 and the rotation of the gear 62, the operation board 65 can be displaced, along the horizontal direction. Operation rods 66 are shown in FIG. 10 and are fixed to operation board 65. As seen in FIG. 11, the rods 66 extend vertically upward on either side of the tray. Attached to each of the operation rods 66 are four long and slender claw plates 67 that are mounted at almost equal intervals. Movement of the rods 66 can displace the claw plates 67. Also, attached to the claw plates 67 are spacer or fingernails members 69 that can be moved into and out of engagement with the stack of notes B. The spacers 69 are positioned at the end of each claw plate 67 near the dispensing unit device D as shown in FIG. 11. Additionally, at both ends of each of the claw plates 67 are horizontally long L-shaped cam openings 60 and at a center portion thereof, a vertical length hole for receipt of the operation rod 66 is formed. In addition, near each of the claw plates 67, a long and slender guide body 64 is formed. These guide bodies 64 are fixed on the frame of the device, respectively. Screws 68 are fixed to each guide body 64 and the claw plates 67 are guided by the respective screws 68 and the camming action of the L-shaped holes 60. As a result, when the operation board 65 is moved at the left side of FIG. 10, the claw plates 67 on both sides are moved to close on the stack of bills and are also moved slightly to the left. As a result, the stack of bundled bills B will be subdivided by the spacer or fingernail members 69 that engages the sides of the bills. In other words, those portions of the stack of bills away from the opening M of the dispensing device D will be pressed by fingernail members 69 to counter a spring bias applied to the stack of bills while the notes near the open aperture M will remain in a free state without a bias pressure.

As can be appreciated, in operation the service technician can insert a storage tray C having a predetermined number of bills that are stacked and biased within the storage tray towards an aperture at one end of the tray. The tray is inserted to be operatively positioned adjacent aperture M of the dispensing unit D. In the preferred embodiment, the pressure reducing feature of the fingernail members 69 can also be utilized to assist in preparing the stack of bills for dispensing. As can be appreciated, however, this pressure reducing feature is optional and it is possible to have an operative dispersing device where the bills are simply biased by a relatively low spring pressure against the aperture M. In such an arrangement, the bills would be slightly pressed to be biased against the open mouth M and this pressure would be further increased when the fan or suction units 23, 24 are activated so that a negative pressure would assist at the open mouth M and the first bill in the stack of notes B will be biased against the open mouth M.

When the electric motor 25 is activated and the pulley 26 is positively rotated to drive the endless belt 38 and it will move in the direction of the arrow shown in FIG. 1. As a result of the friction of the surface of the belt 38 against the surface of the first monetary note, a bill will be dragged in the upper direction. The top portion of the bill will be placed between the rollers 71 in FIG. 7A. Likewise, the bottom end of the first monetary note will pass through the lower portion of the open mouth M. At this time, the passage of the bill will be detected by a pair of optical sensors S7 shown in FIG. 7A. These optical sensors S7 will produce a signal that can be processed by the controller 100 to provide a drive signal to the electric motor 25 to stop and to rotate in a reverse direction for a short distance. Thus, the first note is released from the bundle B and is engaged by the rollers 71. The electric motor 25, when it is rotated in a reverse direction for a brief time period, will cause the endless belt 38 to move downward and thereby will prevent the second note in the bundle B from being dragged along with the first note.

Prior to the driving of the electric motor 25 to dispense the first note, the controller 100 will receive a start signal for distributing a predetermined number of notes. With the receipt of the start signal, the fan devices 23, 24 will be driven while the electric motors 61, 70 are also activated. When the electric motor 61 is activated, as shown in FIG. 10, the pressure reducing device F can be placed into operation. The electric motor 61 is positively rotated so that the operation board 65 is moved to the left, along with the plurality of the claw plates 67 by the operation rods 66. As a result of this movement, the notes within the bundle B that are spaced away from the most forward section of the stack of bills are engaged by the spacers or fingernail members 69, while the bills near the aperture mouth M are placed into a free state without any pressure.

Figure 8:
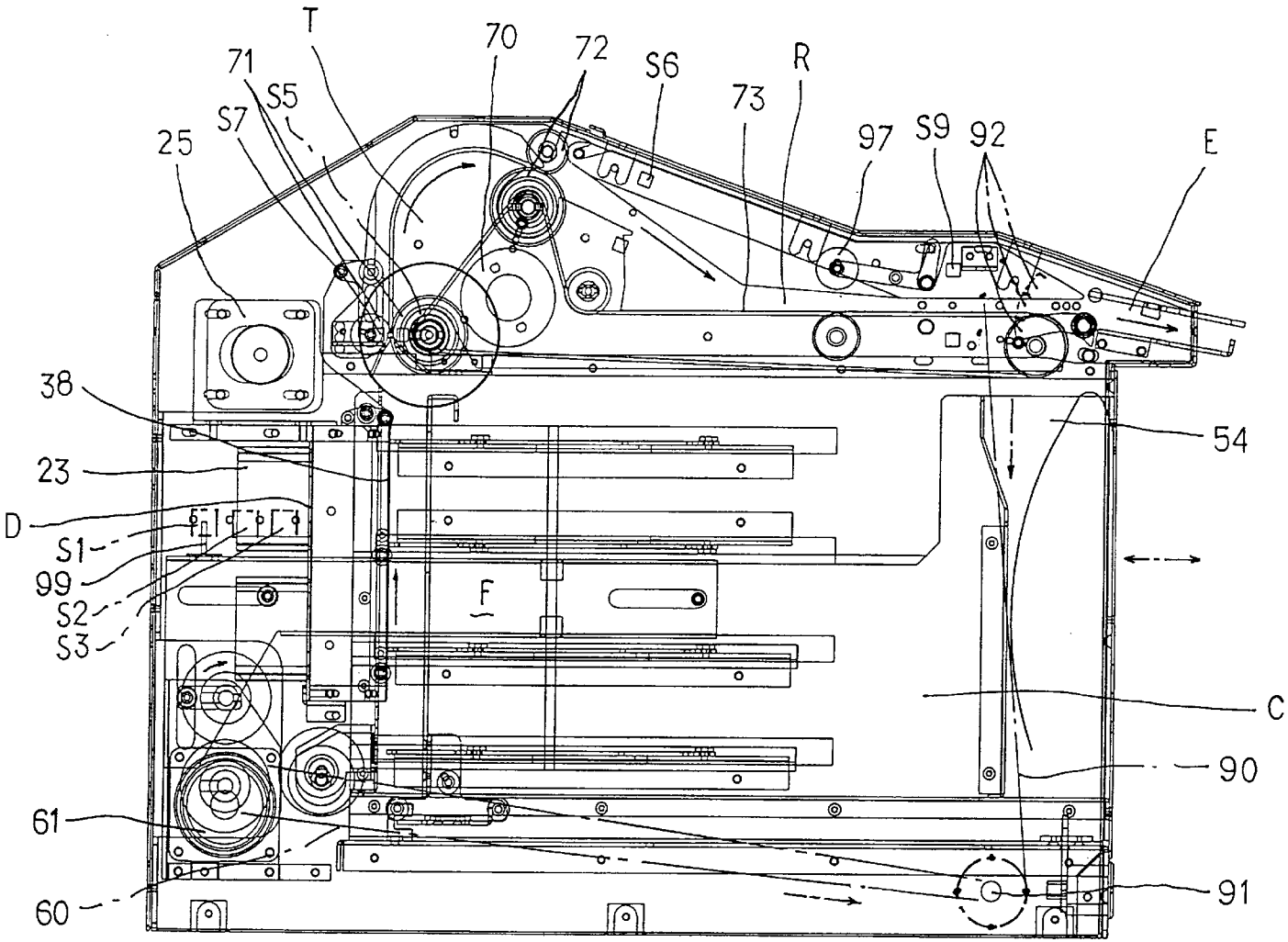
FIG. 8 is a right side sectional view from the other side of FIG. 7A.

When the electric motor 61 is positively rotated, a crank 91 is driven and a pulley and the long belt 60 are also driven. As seen in FIG. 8, the crank mechanism 91 is driven and a link 90 is moved so that a guide piece 92 in the ejection chamber E is rotated upward and is stopped at a storing position shown as 92A. That is, the guide piece 92 is activated to close the exit or passageway from the storing room or chamber R as can be seen in FIG. 8. In summary, the rotational movement of the crank mechanism 91 in effect is converted into a rotational movement with the guide piece 92. With the guide piece 92 in a storing position 92A, a projection member 99 can be detected by a pair of sensors S3 on the operation board 65.

A direct current electric motor 70 that is mounted on the upper part, of FIG. 8, is activated to drive the sending rollers 71, 72, respectively and, also a long belt 73 through a gear train (not shown). When the speed of the driven roller pair 71, 72 and the belt 73 become constant, the speed is detected with a speed sensor S5 and the output of the speed sensor S5 is sent to the controller 100 so that the initial preparation for the distribution of notes from the stored bundled is enabled. At this point, electric motor 25 which is of a step-type can then receive the appropriate signals for the dispensing of the predetermined number of notes.

The rubber belt 38 is driven and the first note is forwarded upward to be placed between the sending pair of rollers 71. As this note is then pulled upward, it can be detected by a pair of optical sensors S7. Upon receipt of this first note and its detection by the sensor S7, the electric motor 25 can then be reversibly rotated so that the endless belt 38 moves in a vertical down direction thereby preventing the succeeding or second note in the bundle from being erroneously sent with the movement of the first note. Additionally, the sensor S7 can also be constructed so that it can determine whether only one note, or more than one note is moved past it. The first note is passed through second rollers 72 to be released and to contact the belt 73 at the top of FIG. 8. When the first note is detected by the sensor S6, the electric motor 25 is stopped and it is then prepared for a subsequent operation, assuming more than one note is to be dispensed. Thus, the electric motor 25, upon receiving a second activation signal, will then withdraw the second note in a similar manner to send the second note to the storing room R. These notes stay in the storing room until the desired number of notes have been dispensed by dispensing unit D. The controller 100, upon determining that the appropriate number of notes have been withdrawn from the bundle, then sends a signal to activate the electric motor 61 which is then positively rotated so that the guide piece 92 will sink and move to a solid line position 92B shown in FIG. 12A. Thereby the exit for the storage chamber room R is then opened. This stage is detected by the projection 99 and the sensor S2 on the operation board 65. Upon detection of the projection 99, the electric motor 70 is stopped and a solenoid for distribution (not shown) is driven at that time. When the roller 97 is pressed by means of the solenoid to the belt 73 the notes that are on the belt will be sent to the exit room E. Sensor S9 can monitor when the notes are removed from exit room E.

Upon confirmation that the notes have been distributed, the electric motor 61 is positively rotated further and the projection 99 is detected by the optical sensor S1. When the sensor S1 confirms the position of the projection 99, the electric motor 61 is stopped and returned to a stand by state and the fan or suction devices 23, 24 are also stopped and held in a stand by state. At this point, the guide piece 92 will be activated to close the exit of the storage chamber R. Additionally, the pressure reducing device F will be returned to a former stand by position also.

If it is detected, that a currency note is in a position of optical sensor S7. The electric motor 61 is reversibly rotated and the guide piece 92 is moved upward to position 92C, shown in FIG. 12B. At the same time, the projection 99 is detected by the optical sensor S2 and the electric motor 61 is stopped and a solenoid (not shown) for distribution is driven and the running belt 63 is pressed by the roller 97. As a result, the notes B in the storage room R is guided by the upwardly positioned and curved guide piece 92 and will be sent downward into the spring-biased collection room 54 which is in the storage tray C. The passage of the notes are detected by the sensor S9. When the passage of the notes are confirmed, the electric motor 61 is rotated positively and prepared for distribution of additional notes as mentioned above.

Various modifications of the present invention can be accomplished as mentioned above, for example, one or more belts may be used, of a rubber or synthetic rubber configuration, or other suitable material to provide adequate friction for contacting and moving the articles to be dispensed. The claw plates 67 of the pressure reducing apparatus F can be made of plastic resin and the number of claw plates 67 on each side can be increased to 3.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. An apparatus for dispensing paper money comprising:

a chamber with an opening adjacent a stack of paper money;

a fan for removing air from within said chamber to draw a first paper money from the stack of paper money to the opening;

a belt disposed between the opening and the stack of paper money, the belt drivable in two traverse directions, forward and backward, with respect to the opening, and the belt positioned to be in contact with the first paper money where:

movement of the belt in the forward direction withdraws the first paper money from the stack of paper money; and movement of the belt in the backward direction prevents a second paper money from being withdrawn with the first paper money from the stack of paper money.

2. A dispensing apparatus for thin flat articles, comprising:

a plenum chamber having an aperture of a size smaller than the articles to be dispensed;

a suction device connected to the plenum chamber to provide sufficient negative pressure to adhere an article to the aperture;

a contact member mounted for movement across the aperture to drive the article adhering to the aperture traverse to the aperture when the contact member is driven; and a mounting bracket and an electric motor, the mounting bracket is mounted on an exterior of the plenum chamber and supports both the electric motor and the contact member which is driven by the electric motor;

wherein the plenum chamber has a base board forming one side of the plenum chamber and extending beyond the plenum chamber to provide support for the mounting bracket; and wherein the mounting bracket includes a guide frame that extends across the aperture and the contact member is an endless belt that is rotatably supported by the guide frame and is mounted on a pulley connected to the electric motor.

3. The dispensing apparatus of claim 2 wherein the suction device includes a fan mounted on a rear opening of the plenum chamber apparatus to the aperture.

4. The dispensing apparatus for monetary bills, comprising:

a plenum chamber having an aperture;

a suction device connected to the plenum chamber to provide sufficient negative pressure to force a monetary bill from a stack of bills to adhere to the aperture;

an endless member mounted for movement across the aperture to frictionally drag against the negative pressure, the monetary bill to remove it from the stack of bills;

a motor for driving the endless member; and a controller for activating the motor and a sensor member for monitoring the movement of the monetary bill as it is released from the adherence to the aperture, the controller upon receipt of a signal from the sensor member indicating the release of the monetary bill enables the motor to drive the endless member in a reverse direction to prevent a succeeding monetary bill from the stack of bills to also be released with the initial monetary bill.

5. A dispensing apparatus for dispensing a predetermined number of thin flat articles from a stack of articles, comprising:

a plenum chamber having an aperture, a suction device connected to the plenum chamber to provide sufficient negative pressure to adhere an uppermost article from the stack of articles to the aperture;

a contact member mounted across the aperture to move the adhered article against the negative pressure to remove it from the stack of articles;

a first motor for driving the member;

means for biasing the stack of articles towards the aperture; and a pressure reducing aperture for contacting the stack of articles and restraining some of the stacked articles against the biasing force;

wherein the pressure reducing apparatus includes a plurality of spacer members for engaging edges of the stack of articles, and wherein the spacer members are releasably cammed into engagement with the stack of articles.

6. The dispensing apparatus of claim 5 further including means for removably engaging the spacer members with the stack of articles prior to activating the first motor.

7. The dispensing apparatus of claim 6 further including a second motor for driving the spacer members.

8. A dispensing apparatus for dispensing a predetermined number of thin flat articles from a stack of articles, comprising:

a plenum chamber having an aperture, a suction device connected to the plenum chamber to provide sufficient negative pressure to adhere an uppermost article from the stack of articles to the aperture;

a contact member mounted across the aperture to move the adhered article against the negative pressure to remove it from the stack of articles;

a first motor for driving the member;

means for biasing the stack of articles towards the aperture;

a pressure reducing aperture for contacting the stack of articles and restraining some of the stacked articles against the biasing force; and a storage tray for holding the stack of articles and the means for biasing includes a spring member for exerting a force on a support member that is movable within the storage tray, wherein the storage tray includes a return bin for receiving articles inadvertently removed from the storage tray and the return bin includes a flexible retainer for holding returned articles.

* * * * *